US005568043A

United States Patent [19]

Wu

[11] Patent Number: 5,568,043

[45] Date of Patent: Oct. 22, 1996

[54] DUAL VOLTAGE GENERATION CIRCUIT

[75] Inventor: Ming-Jer Wu, Taoyuan, Taiwan

[73] Assignee: Acer Peripherals, Inc., Taoyuan, Taiwan

[21] Appl. No.: 509,735

[22] Filed: Aug. 1, 1995

[51] Int. Cl.[6] ..... G05F 1/613; G05F 1/618; G05F 1/325

[52] U.S. Cl. ..... 323/231; 323/350

[58] Field of Search ..... 323/231, 349, 323/350, 351; 327/584

[56] References Cited

U.S. PATENT DOCUMENTS 3,577,062 5/1971 Hoffman ..... 323/8

4,390,829 6/1983 Jarrett ..... 323/231

4,933,572 6/1990 Smith et al. ..... 307/296.1

*Primary Examiner*—Peter S. Wong

*Assistant Examiner*—Bao Q. Vu

*Attorney, Agent, or Firm*—Fish & Richardson P.C.

[57] ABSTRACT

A dual voltage generation circuit, responsive to a switching signal, to selectively generates a constant voltage at an output terminal is provided. The generation circuit comprises a switch transistor, a first and a second zener diodes and a diode. As the switching signal is logic high, at the output terminal, the circuit outputs a first constant voltage, and as the switching signal is logic low, the circuit outputs a second constant voltage.

1 Claim, 1 Drawing Sheet

DUAL VOLTAGE GENERATION CIRCUIT

TECHNICAL FIELD OF THE INVENTION

The invention relates to a voltage generation circuit which, responsive to a switching signal, selectively generates a first constant voltage or a second constant voltage.

BACKGROUND OF THE INVENTION

In design of many electronic circuits, e.g. cordless telephone circuit, a voltage generation circuit which is capable of generating a first constant or a second constant voltage is required for the frequency synthesis purpose. Operational amplifier may be used to effect the mentioned purpose, provided cost and stability thereof are not a major concern.

SUMMARY OF THE INVENTION

A dual voltage generation circuit for, responsive to a switching signal, selectively generating a constant voltage at an output terminal is therefore provided.

The circuit comprises a switch transistor NPN, a first and a second zener diodes ZD1, ZD2 and a diode D1. The switch transistor NPN, has an emitter, a collector and a base, for inputing the switching signal at the base, and the collector is coupled to a reference voltage via a first resistor. The first zener diode ZD1 has an anode coupled to a reference ground and a cathode coupled to the reference voltage via a second resistor. The second zener diode ZD2 has an anode and a cathode, the anode is coupled to the reference ground, the cathode is coupled to the emitter of the switch transistor NPN. The diode D1 has an anode coupled to the cathode of the first zener diode ZD1, and a cathode coupled to the cathode of the second zener diode ZD2. The output terminal is formed at the cathode of the second zener diode ZD2.

BRIEF DESCRIPTION OF THE APPENDED DRAWINGS

FIGURE 1 shows the circuit in accordance with the invention.

DETAILED DESCRIPTION OF THE INVENTION

Figure 1:
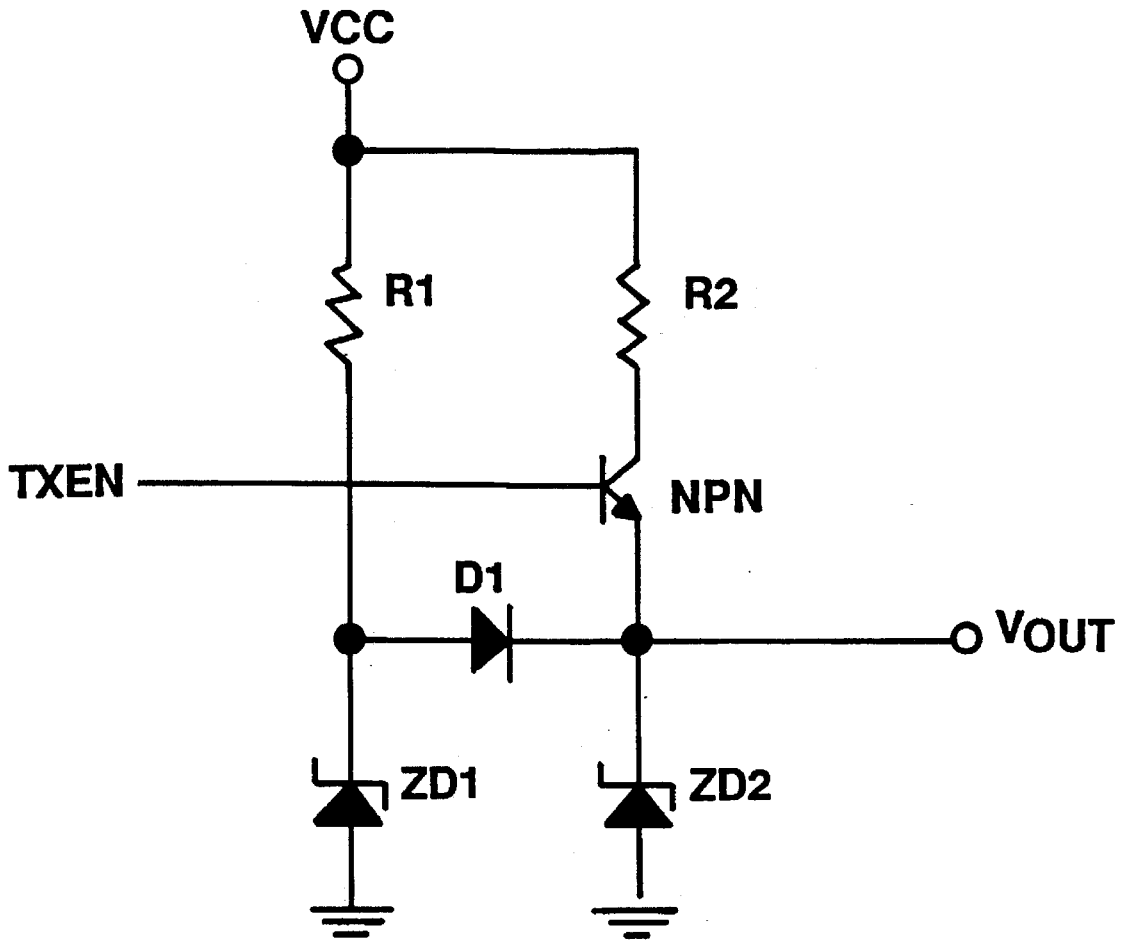

As shown in FIG. 1, the dual voltage generation circuit provided comprises a switch transistor NPN, a first and a second zener diodes ZD1, ZD2 and a diode D1. Responsive to a switching signal TXEN, the circuit selectively generates a first constant voltage and a second constant voltage at an output terminal.

The switch transistor NPN has an emitter, a collector and a base, for inputing the switching signal TXEN at the base. The collector is coupled to a reference voltage via a first resistor R2.

The first zener diode ZD1 has an anode coupled to a reference ground and a cathode coupled to the reference voltage via a second resistor R1.

The second zener diode ZD2 has an anode and a cathode, the anode is coupled to the reference ground, the cathode is coupled to the emitter of the switch transistor NPN.

The diode D1 has an anode coupled to the cathode of the first zener diode ZD1, and a cathode coupled to the cathode of the second zener diode ZD2. The output terminal is formed at the cathode of the second zener diode ZD2.

Reference is made to the following recitations of operation of the invention. The ZD1 is selected and always operated in its breakdown voltage. The ZD2 is selected such that, when it is operated in its breakdown voltage, Vzd1 is smaller than Vzd2.

As switch signal TXEN is logic low, the NPN is cutoff due to Emitter-Base junction being reverse-biased. As a result, the output voltage Vout at the terminal is Vzd1-0.7.

As switch signal TXEN is logic high, the NPN is saturated due to Collector-Base junction and Emitter-Base junction all being forward-biased. At this time, ZD2 also reaches its breakdown voltage point. However, since Vzd1 is smaller than Vzd2, the diode D1 is reverse-biased which isolates the influence of ZD1 on the output terminal. As a result, the output voltage Vout at the output terminal is Vzd2.

The resistor R1 and R2 are provided to control the magnitude of biasing current through ZD1 and ZD2.

What is claimed is:

1. A dual voltage generation circuit for, responsive to a switching signal, selectively generating a constant voltage at an output terminal, comprising:

a switch transistor, having an emitter, a collector and a base, for inputting the switching signal at the base, the collector being coupled to a reference voltage via a first current-regulating element;

a first zener diode having an anode coupled to a reference ground and a cathode coupled to the reference voltage via a second current-regulating element;

a second zener diode having an anode and a cathode, the anode being coupled to the reference ground, the cathode being coupled to the emitter of the switch transistor;

a diode having an anode coupled to the cathode of the first zener diode, and a cathode coupled to the cathode of the second zener diode;

wherein the output terminal is formed at the cathode of the second zener diode.

* * * * *